US008479404B1

(12) United States Patent
Samson et al.

(10) Patent No.: US 8,479,404 B1
(45) Date of Patent: Jul. 9, 2013

(54) FIREARM TOOL

(75) Inventors: Scott W. Samson, Whately, MA (US); Severt Swenson, Downers Grove, IL (US)

(73) Assignee: Samson Manufacturing Corporation, Keene, NH (US)

( * ) Notice: Subject to any disclaimer, the term of this patent is extended or adjusted under 35 U.S.C. 154(b) by 530 days.

(21) Appl. No.: 12/687,352

(22) Filed: Jan. 14, 2010

Related U.S. Application Data

(60) Provisional application No. 61/144,697, filed on Jan. 14, 2009.

(51) Int. Cl.
*G01B 1/00* (2006.01)

(52) U.S. Cl.
USPC ..... 33/506

(58) Field of Classification Search
USPC ..... 33/501.45, 501.05, 501.18, 506; 42/90, 42/95, 106
See application file for complete search history.

(56) References Cited

U.S. PATENT DOCUMENTS 4,819,289 A * 4/1989 Gibbs ..... 7/118
5,199,180 A * 4/1993 Yablonsky ..... 33/501.45
5,570,513 A * 11/1996 Peterson ..... 33/506
5,604,989 A * 2/1997 Stevenson ..... 33/506
6,813,842 B2 * 11/2004 Wang ..... 33/501.45
6,907,766 B2 6/2005 Garrett, Jr. et al.
7,117,626 B1 * 10/2006 Alzamora et al. ..... 42/108
7,607,237 B2 * 10/2009 Schafer ..... 33/501.45
7,637,049 B1 * 12/2009 Samson et al. ..... 42/108
2002/0092190 A1 * 7/2002 Hofer et al. ..... 33/501.45
2006/0162224 A1 * 7/2006 Connal ..... 42/108
2008/0276475 A1 * 11/2008 Schafer ..... 33/501.45
2009/0145785 A1 * 6/2009 Garrett ..... 42/95
2009/0199345 A1 * 8/2009 Morgan ..... 7/118
2011/0283588 A1 * 11/2011 Samson et al. ..... 42/108

OTHER PUBLICATIONS

U.S. Appl. No. 12/506,754, filed Jul. 21, 2009, now U.S. Patent 7,637,049 issued on Dec. 29, 2009. Applicants: Scott W. Samson, et al.

* cited by examiner

*Primary Examiner* — Yaritza Guadalupe-McCall

(74) *Attorney, Agent, or Firm* — Burns & Levinson LLP; Bruce D. Jobse, Esq.

(57) ABSTRACT

A tool for a firearm provides a member including a curved edge forming a comparison template adapted for comparison with feed slot elements of an ammunition magazine suitable for use with the firearm, for determining curvature corrections needed for the feed slot elements.

10 Claims, 3 Drawing Sheets

FIREARM TOOL

CROSS REFERENCE TO RELATED APPLICATIONS

This application claims priority to U.S. Provisional Application Ser. No. 61/144,697 filed Jan. 14, 2009 and entitled FIREARM TOOL, which is incorporated by reference herein in its entirety for all purposes.

BACKGROUND OF THE INVENTION

The proper operation of a military firearm is of critical importance in combat situations. Unfortunately, a variety of firearm malfunctions can occur that render the firearm useless until repairs can be performed, and these repairs typically include the use of proper tools.

In view of the importance of performing necessary repairs on an inoperative firearm, it would be beneficial to have ready and useful access to proper tools suitable for correcting firearm malfunctions.

SUMMARY OF THE INVENTION

Disclosed is a tool for a firearm comprising a member including a curved edge forming a comparison template adapted for comparison with feed slot elements of an ammunition magazine suitable for use with the firearm, for determining curvature corrections needed for the feed slot elements. The member may include an indicator mark for positioning a magazine during a comparison with the template. The curved edge may form a comparison template for more than one type of magazine.

According to one embodiment, an apparatus for measuring the curvature of feed slot elements of an ammunition magazine or cartridge comprises a substantially rigid member having a curved edge formed therein and at least one indicia on the rigid member identifying a specific point on the curved edge associated with correct curvature of the feed slot elements of a first ammunition magazine. In other embodiments, a second indicia on the rigid member identifies a specific point on the curved edge associated with correct curvature of the feed slot elements of a second ammunition magazine.

According to another embodiment, a method for measuring the curvature of feed slot elements of an ammunition magazine or cartridge comprises: providing a substantially rigid member having a curved edge formed therein, the curved edge having at least one indicia on the rigid member identifying a specific point on the curved edge associated with correct curvature of the feed slot elements of a first ammunition magazine; aligning a feed slot element of the first ammunition magazine with the indicia on the curved edge of the substantially rigid member; and determining if a curvature profile of the feed slot element substantially complies with a radius of curvature of the curved edge. In other embodiments, the method further comprises modifying the curvature profile of the feed slot element to substantially comply with the radius of curvature of the curved edge and determining if the modified curvature profile of the feed slot element substantially complies with the radius of curvature of the curved edge.

BRIEF DESCRIPTION OF THE DRAWINGS

The present invention is illustratively shown and described in reference to the accompanying drawing in which.

DETAILED DESCRIPTION OF THE DRAWINGS

Figure 1:
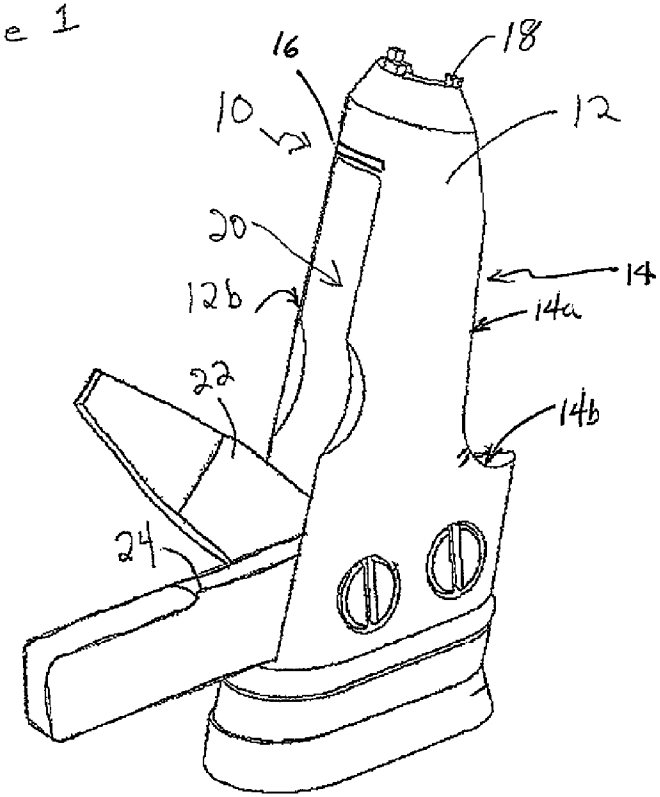
FIG. 1 is side perspective view of a firearm accessory into which the tool may be implemented.
Figure 2:
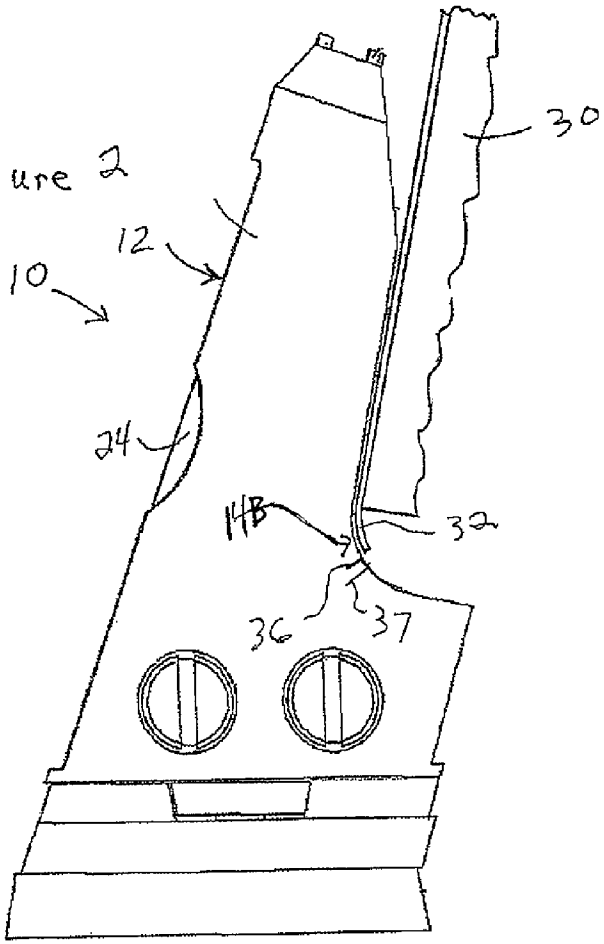
FIG. 2 is a side view of the tool and a cut away portion of an ammunition magazine located for physical comparison therebetween.

Combat firearms suffer from various types of malfunctions which can render the firearm inoperative. One such malfunction is the bending of feed lips on ammunition magazines. The present invention provides a tool which may be used to determine if such magazine feed lips are in need of adjustment to assure proper functioning of the firearm FIG. 1 illustrates a firearm accessory multitool 10 such as that described in U.S. Pat. No. 7,637,049, into which the disclosed firearm tool may be integrated. Multitool 10 comprises a substantially rigid member or frame 12 having a cavity 20 formed therein into which a screwdriver 22 and scraper 24 are pivotally mounted. Also integrally formed within the frame 12 are a gun site adjustment 18 and slot 16. Slot 16 maybe sized to allow the sheet metal from an ammunition cartridge or magazine to fit within slot 16 to allow the multitool 10 to be used for bending the sheet metal of the cartridge to correct the same. Also formed within the frame 12 is adjustment tool 14 defining a straight edge or surface portion 14*a* and a curved portion 14*b*. Straight portion 14*a* is used to align a cartridge or magazine while curved portion 14*b* serves as a template for measuring the curvature of feed slot elements of an ammunition magazine or cartridge. FIG. 2 shows a side view of tool 14 adjacent to a cross-sectioned portion of a cartridge or ammunition magazine 30. Magazine 30 includes a feed lip 32 which impacts cartridges as they are fed from magazine 30 into a firearm. Edge portion or surface 14*b* contains a surface radius substantially similar to the proper curvature of feed lip 32. Thus, tool 14 may be held adjacent to magazine 30 and used as a template for comparison, as shown, to determine whether lip 32 is properly curved or in need of adjustment.

Figure 3:
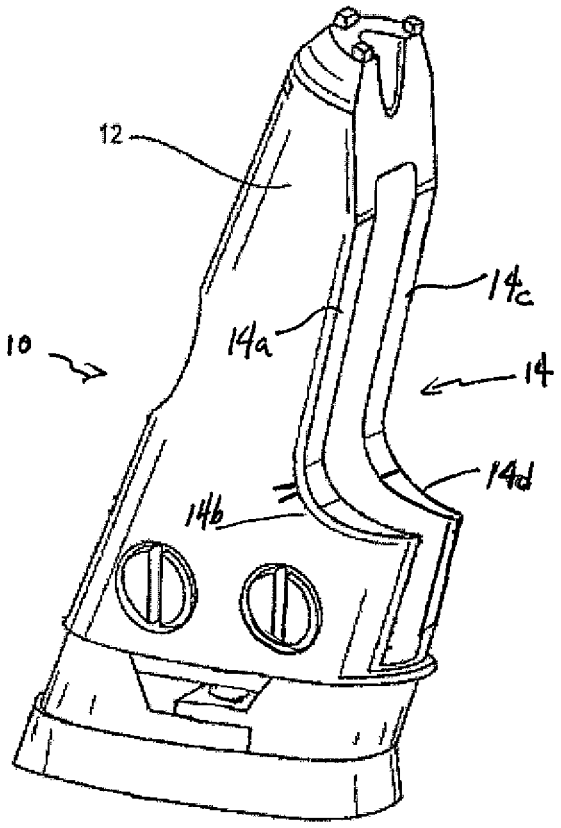
FIG. 3 is another side perspective view of the tool having a pair the of curved surfaces.

Curved edge 14*b* may include one or more indicia 36 and 37 to aid with the measurement of magazine feed lip curvature. Indicia 36 and 37 represent different magazines for which tool 14 may be used for assessing curvature. Typically, indicia 36 and 37 would represent the end of feed lip 32 for a particular type of magazine. In the event that lip 32 is in need of adjustment, any suitable tool may be used to engage lip 32, such as slot 16 integrally formed into multitool 10, to apply bending force. As illustrated in FIG. 3, tool 14 may comprise a plurality of edges or surfaces each having a substantially straight portion and a curved portion. Straight portion 14*c* may be the same or different than portion 14*a*, while curved portion 14*d* may be the same or different than portion 14*b*.

In use, the lip 32 of magazine 30 is aligned with the indicia 36 or 37 on the curved edge 14*b* of tool 14 to determine if the curvature profile of the feed slot element substantially complies with a radius of curvature of the curved edge. If not, lip 32 of magazine 30 may be modified or bent and re-measured, as necessary.

The present invention is illustratively described above in reference to the disclosed embodiments. Various modifications and changes may be made to the disclosed embodiments by persons skilled in the art without departing from the scope of the present invention as defined in the appended claims.

What is claimed is:

1. An apparatus for measuring the curvature of feed slot elements of an ammunition magazine or cartridge comprising:

a substantially rigid member having a first curved edge formed therein;

at least one indicia on the rigid member identifying a specific point on the curved edge associated with correct curvature of the feed slot elements of a first ammunition magazine; and a second curved edge formed in the substantially rigid member having a radius of curvature different from the first curved edge.

2. The apparatus of claim 1 further comprising:

a second indicia on the rigid member identifying a specific point on the curved edge associated with correct curvature of the feed slot elements of a second ammunition magazine.

3. The apparatus of claim 2 wherein the first ammunition magazine and second ammunition magazine have feed slot elements of different dimensions.

4. The apparatus of claim 2 wherein the wherein the curved edge forms a comparison template for more than one type of ammunition magazine.

5. The apparatus of claim 1 further comprising:

a second indicia on the rigid member identifying a specific point on the second curved edge associated with correct curvature of the feed slot elements of a second ammunition magazine.

6. The apparatus of claim 1 wherein the rigid member is part of a firearm tool.

7. A method for measuring the curvature of feed slot elements of an ammunition magazine or cartridge comprising:

providing a substantially rigid member having a curved edge formed therein, the curved edge having at least one indicia on the rigid member identifying a specific point on the curved edge associated with correct curvature of the feed slot elements of a first ammunition magazine;

aligning a feed slot element of the first ammunition magazine with the indicia on the curved edge of the substantially rigid member; and determining if a curvature profile of the feed slot element substantially complies with a radius of curvature of the curved edge.

8. The method of claim 7 further comprising:

modifying the curvature profile of the feed slot element to substantially comply with the radius of curvature of the curved edge.

9. The method of claim 8 further comprising:

determining if the modified curvature profile of the feed slot element substantially complies with the radius of curvature of the curved edge.

10. An apparatus for measuring the curvature of feed slot elements of an ammunition magazine or cartridge comprising:

a substantially rigid member having first and second curved edges formed therein, the second curved edge having a radius of curvature different from a radius of curvature of the first curved edge; and at least one indicia on the rigid member identifying a specific point on one of the first and second curved edges associated with correct curvature of the feed slot elements of a first ammunition magazine.

* * * * *

UNITED STATES PATENT AND TRADEMARK OFFICE

CERTIFICATE OF CORRECTION

PATENT NO. : 8,479,404 B1
APPLICATION NO. : 12/687352
DATED : July 9, 2013
INVENTOR(S) : Scott W. Samson and Severt Swenson It is certified that error appears in the above-identified patent and that said Letters Patent is hereby corrected as shown below:

In the Claims

In Column 3, line 22 (Claim 4), "wherein the wherein the curved" should read -- wherein the curved --

Signed and Sealed this
Nineteenth Day of November, 2013

Teresa Stanek Rea

Teresa Stanek Rea
*Deputy Director of the United States Patent and Trademark Office*